US011201385B2

(12) United States Patent
Oh et al.

(10) Patent No.: US 11,201,385 B2
(45) Date of Patent: Dec. 14, 2021

(54) ANTENNAS FOR METAL HOUSINGS

(71) Applicant: Hewlett-Packard Development Company, L.P., Spring, TX (US)

(72) Inventors: Sung Oh, Palo Alto, CA (US); Chris Kruger, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,821

(22) PCT Filed: Mar. 16, 2018

(86) PCT No.: PCT/US2018/022816
§ 371 (c)(1),
(2) Date: Jul. 29, 2019

(87) PCT Pub. No.: WO2019/177619
PCT Pub. Date: Sep. 19, 2019

(65) Prior Publication Data

US 2021/0336324 A1 Oct. 28, 2021

(51) Int. Cl.

| | |
|---|---|
| ***H01Q 1/22*** | (2006.01) |
| ***H01Q 13/10*** | (2006.01) |
| ***H01Q 9/42*** | (2006.01) |
| ***H01Q 1/48*** | (2006.01) |
| ***H01Q 21/28*** | (2006.01) |

(52) U.S. Cl.
CPC ..... *H01Q 1/2266* (2013.01); *H01Q 1/2291* (2013.01); *H01Q 1/48* (2013.01); *H01Q 9/42* (2013.01); *H01Q 13/10* (2013.01); *H01Q 21/28* (2013.01)

(58) Field of Classification Search
CPC ..... H01G 1/2266; H01G 1/2291; H01G 1/48; H01G 9/42; H01G 13/10; H01G 21/28
See application file for complete search history.

(56) References Cited

U.S. PATENT DOCUMENTS

| | | | |
|---|---|---|---|
| 9,673,507 | B2 | 6/2017 | Ramachandran et al. |
| 2004/0017319 | A1 | 1/2004 | Wang et al. |
| 2014/0132462 | A1 | 5/2014 | Ying |
| 2015/0147984 | A1 | 5/2015 | Ying et al. |
| 2015/0244061 | A1 | 8/2015 | Galeev |
| 2016/0079655 | A1 | 3/2016 | Gu et al. |
| 2017/0040668 | A1 | 2/2017 | Vazques et al. |
| 2017/0077603 | A1 | 3/2017 | Krogerus |

(Continued)

FOREIGN PATENT DOCUMENTS

| | | | |
|---|---|---|---|
| CN | 105337022 | A | 2/2016 |
| CN | 106848534 | A | 6/2017 |
| CN | 107257017 | A | 10/2017 |

OTHER PUBLICATIONS

Di Wu, et al, A compact slot MIMO antenna for smartphones with metal housing, Sep. 20, 2017, Taylor & Francis Group.

*Primary Examiner* — Graham P Smith
(74) *Attorney, Agent, or Firm* — HPI Patent Department

(57) ABSTRACT

An example of a device including a display panel and a border region around the display panel is provided. The device includes a cover disposed on the display panel and the border region. The cover is to protect the display panel and the border region. The device also includes an antenna with a keep-out area disposed within a portion of the border region. The device includes a bezel disposed in the keep-out area to support the cover. The bezel includes a partially filled portion to reduce a resonance shift of the antenna.

15 Claims, 6 Drawing Sheets

(56) References Cited

U.S. PATENT DOCUMENTS

| | | | |
|---|---|---|---|
| 2017/0214136 | A1 | 7/2017 | Irci et al. |
| 2017/0256843 | A1 | 9/2017 | Hu et al. |
| 2017/0324150 | A1 | 11/2017 | Liu et al. |

ANTENNAS FOR METAL HOUSINGS

BACKGROUND

Computing devices, such as laptops, tablets, and smartphones, generally include an antenna array to send and to receive signals over wireless networks. As devices become more compact, locations in which the antenna is placed is more restricted such that components of the computing device to interfere with antenna performance.

BRIEF DESCRIPTION OF THE DRAWINGS

Reference will now be made, by way of example only, to the accompanying drawings in which.

DETAILED DESCRIPTION

As more devices incorporate a thin profile surrounded by a metal housing, antenna design becomes more challenging. In particular, the presence of metal around an antenna array may limit the radiation performance of the antennas. In addition, the decrease in volume in which multiple antennas are place increase effects such as mutual coupling which may be detrimental to the performance of the antenna array. As wide area networks increase bandwidth capabilities, more antennas are called for in the next generation networks.

In this specification, elements may be described as "configured to" perform one or more functions or "configured for" such functions. In general, an element that is configured to perform or configured to perform a function is enabled to perform the function, or is suitable to perform the function, or is adapted to perform the function, or is operable to perform the function, or is otherwise capable to perform the function.

In describing the components of the device and alternative examples of some of these components, the same reference number may be used for elements that are the same as, or similar to, elements described in other examples. As used herein, any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components will, in practice, be utilized in orientations that are the same as, or different than those described or shown.

Figure 1:
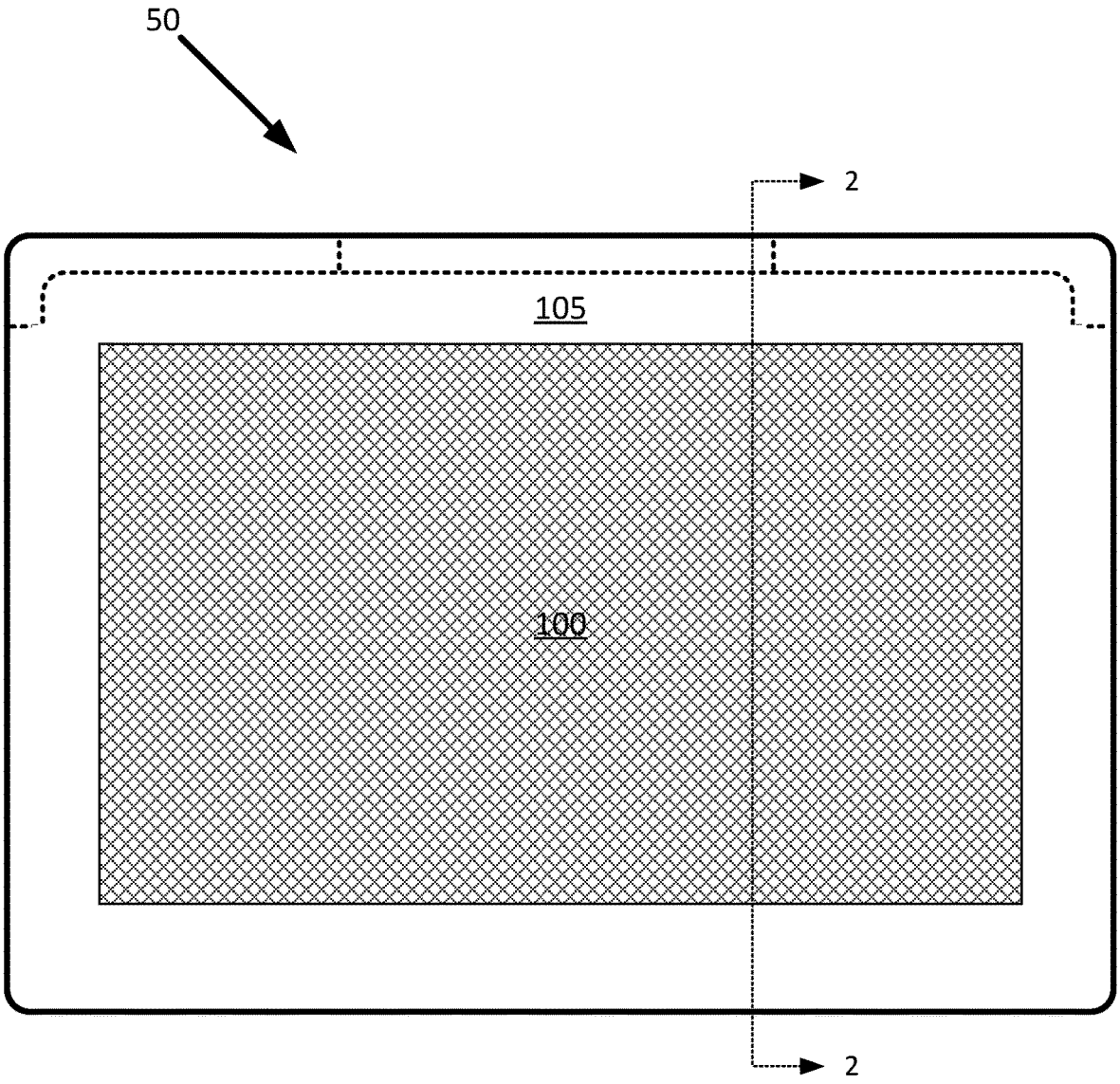
FIG. 1 is a top view of a device in accordance with an example.
Figure 2:
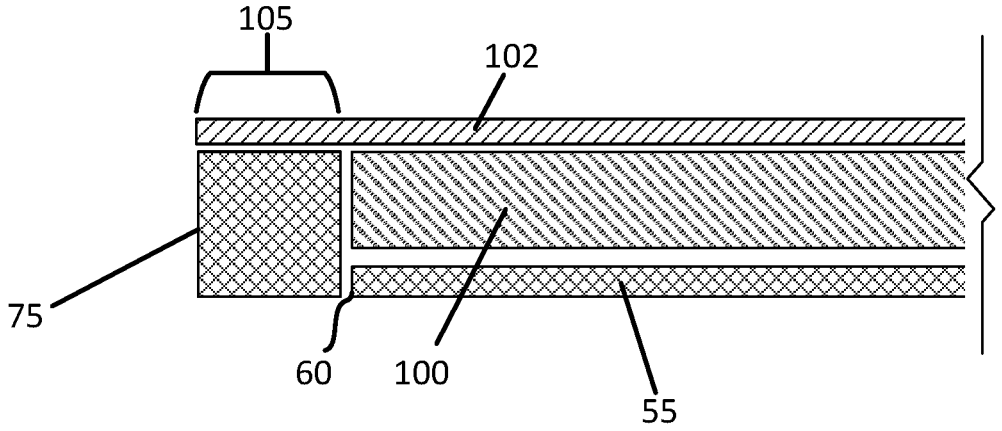
FIG. 2 is a partial cross-section view of the example device of FIG. 1 through the line 2-2.

Referring to FIG. 1, a device is generally shown at 50. The device 50 is not particularly limited and may be a mobile computing device, such as a laptop computer, a tablet, a smartphone capable to connect to multiple wireless networks, such as a wireless wide area network and a wireless local area network. In the present example, the device 50 is a tablet capable to connect to low-band wireless wide area networks that operate between 699 MHz to 960 MHz, mid-band wireless wide area networks that operate between 1710 MHz to 2170 MHz, and/or high-band wireless wide area networks that operate between 2305 MHz to 2690 MHz. In addition, the device 50 may also connect to a Wi-Fi network, such as one that operates at 2.4 GHz or 5 GHz. Furthermore, the device 50 may also be configured to connect with a global positioning system for navigation purposes. In other examples, the device 50 may be configured to connect to other wireless networks, such as a Bluetooth network. In the present example, the device 50 includes a display panel 100 and a cover 102 as shown in FIG. 2. The device 50 also includes a housing 55 and a border region 105 around the display 100.

The display 100 is to display information for a user. For example, the display 100 may include one or more light emitters such as an array of light emitting diodes (LED), liquid crystals, plasma cells, or organic light emitting diodes (OLED). Other types of light emitters may also be substituted. Furthermore, a touch membrane may be overlaid on the display 100 to provide a touchscreen input device. The touch membrane is not limited to any type of touch membrane and may include resistive technology, surface acoustic wave technology, capacitive technology, infrared technology, or optical imaging technology.

The border region 105 around the display 100 is an area that is typically required to provide the structural components to support and protect the display 100. For example, the border region 105 generally includes additional plastic or metal features to securely hold the display 100 in place and to prevent damage from shock such a fall or drop of the device 50. In addition, the border region 105 may also provide a location to store various other components of the device 50, such as a battery, cameras, ambient light sensors, iris sensor, additional sensors, various circuitry, speakers, microphones, and an antenna array. It is to be appreciated that the border region 105 is generally the only area for some of the above-mentioned components of the device without interfering with the display 100 while maintaining the thin profile of modern devices.

The cover 102 is disposed over the display 100 and extends over the border region 105 as well. In the present example, the cover 102 is a hard and transparent material, such as glass, sapphire, plastic, etc. to protect the display 100 and any components disposed within the border region 105. In other examples, the cover 102 may be made from different materials over the display 100 and the border region 105. In particular, since the cover 102 does not need to be transparent over the border region 105, an opaque material may be substituted.

Figure 3:
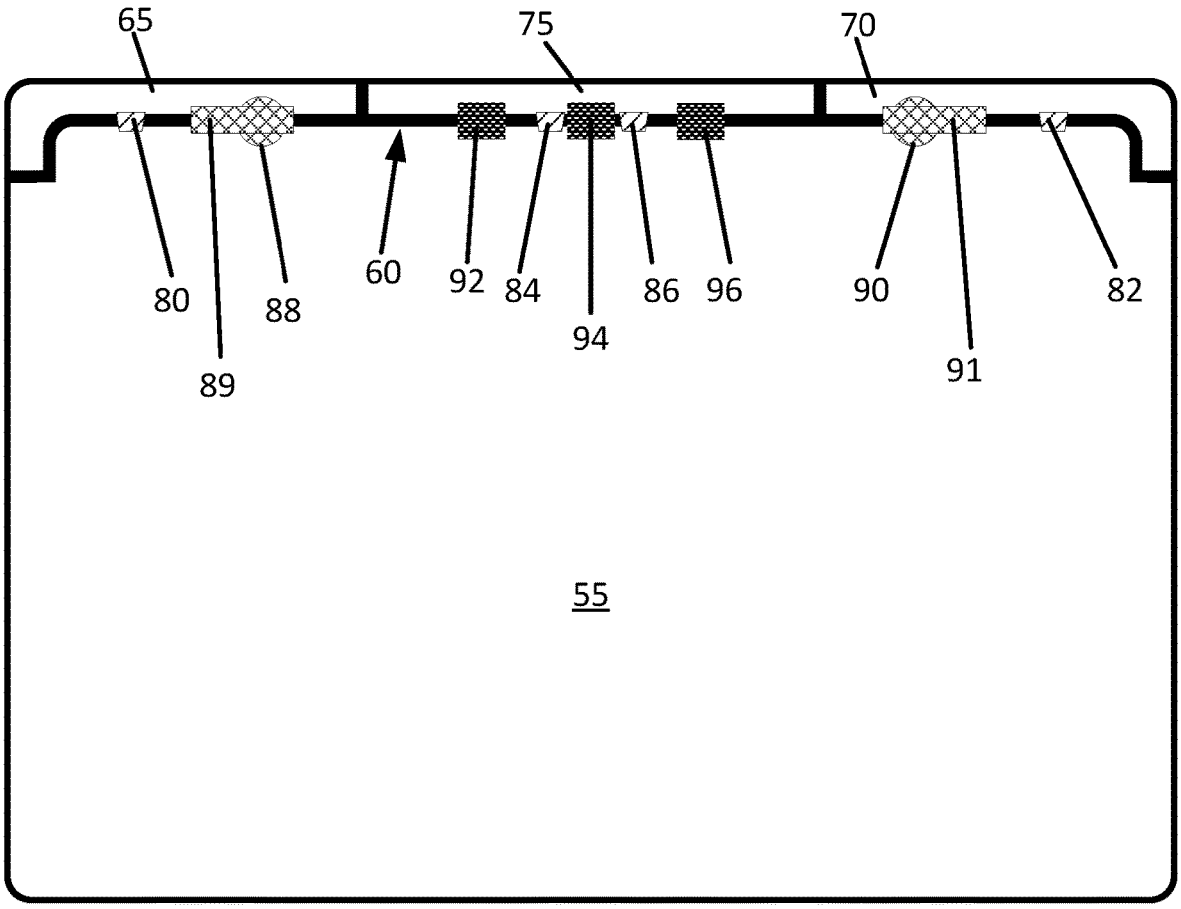
FIG. 3 is a top view of components forming an antenna array of the example device.

Referring to FIG. 3, a view of a housing 55 of device 50 is generally shown a point of view in the front of the device 50 shown in FIG. 1. Accordingly, the view shown in FIG. 3 is similar to view of the device 50 with the cover 102 and the display 100 removed to expose the housing 55 which is to be used in an antenna array.

The housing 55 is not particularly limited and is to enclose the internal components of the device 50. In the present example, the housing 55 is a metal housing which may be manufactured from aluminum, steel, titanium, zinc, alloys, and chrome plated material. In the present example, the housing 55 includes a metal edge 60 which is substantially straight and substantially extends along one side of the device 50.

Located across the metal edge 60 of the housing 55, a metal band 65 is positioned substantially parallel to the metal edge 60 and proximate to a corner of the device 50. The metal band 65 is not particularly limited and may be manufactured from the same material as the housing 55. In some examples, the metal band 65 may be cut from a unitary metal piece which ultimately may be shaped into the housing 55. The metal band 65 is substantially separated from the metal edge 60 of the housing 55. The manner by which the metal band 65 is separated is not particularly limited and may include the use of an air gap or other dielectric material, such as plastic. For example, the metal band 65 may be generally separated from the metal edge 60 with a layer of polypropylene, polycarbonate, polyethylene, ceramic, glass-filled polycarbonate, and glass. Although the metal band 65 is substantially separated from the metal edge 60, the metal band 65 is connected to the metal edge 60 by a feed element 80.

Similarly, located across the metal edge 60 of the housing 55 at the opposite corner of the metal band 65, a metal band 70 is positioned substantially parallel to the metal edge 60. The metal band 70 is not particularly limited and may be manufactured from the same material as the housing 55 and/or the metal band 65. In some examples, the metal band 70 may also be cut from a unitary metal piece which ultimately may be shaped into the housing 55. The metal band 70 is substantially separated from the metal edge 60 of the housing 55. The manner by which the metal band 70 is separated is not particularly limited and may include the use of an air gap or other dielectric material, such as plastic. For example, the metal band 70 may be generally separated from the metal edge 60 with a layer of polypropylene, polycarbonate, polyethylene, ceramic, glass-filled polycarbonate, and glass. Although the metal band 70 is substantially separated from the metal edge 60, the metal band 70 is connected to the metal edge 60 by a feed element 82.

An additional metal band 75 is disposed between the metal band 65 and the metal band 70. The metal band 75 is also positioned substantially parallel to the metal edge 60 and substantially separated from the metal edge 60 of the housing 55. The manner by which the metal band 75 is separated is not particularly limited and may include the use of an air gap or other dielectric material, such as plastic or any material used to separate the metal band 65 or the metal band 70 from the edge 60 discussed above. Although the present example illustrates that the material used to separate the metal band 65, the metal band 70, and the metal band 75 is the same, other examples may use a different material between the metal band 65, the metal band 70, and the metal band 75.

In the present example, the metal band 75 is connected to the metal edge 60 with a plurality of grounding taps 92, 94, 96 as shown in FIG. 3. It is to be appreciated that the grounding tap 92 and the grounding tap 94 may form a closed slot antenna structure with a feed element 84. Similarly, the grounding tap 94 and the grounding tap 96 may form another closed slot antenna structure with a feed element 86.

As shown in FIG. 3, it is to be appreciated that the housing 55 may be used as part of an antenna array to connect with various wireless wide area networks and wireless local area networks. In the present example, the antenna array includes the feed elements 80, 82, 84, 86 connected to various parts of the housing 55 as well as feed elements 88 and 90.

The feed element 80 is to connect the edge 60 of the housing 55 to the metal band 65. Accordingly, the metal band 65 is to form an antenna directly connected to the housing 55 which uses the form factor of the housing 55 as part of the antenna array. Similarly, the feed element 82 is to connect the edge 60 of the housing 55 to the metal band 70 such that the metal band 70 forms another antenna with another part of the housing 55 to be part of the antenna array. The antennas include feed elements 80, 82 may be used to operate in a first mode for a wide area network, such as a 2×2 Long-Term Evolution (LTE) multiple-input and multiple-output (MIMO) antenna array to connect to low-band wireless wide area networks that operate between 699 MHz to 960 MHz, mid-band wireless wide area networks that operate between 1710 MHz to 2170 MHz, and/or high-band wireless wide area networks that operate between 2305 MHz to 2690 MHz. In particular, the metal band 65 may be the main antenna for this operation and the metal band 70 may be used as a diversity antenna in this mode. In addition, it is to be appreciated that the metal band 70 may also be used by itself as an antenna for a global positioning system. Similarly, the slot antennas on the metal band 75 may each also be used by themselves as an antenna for a global positioning system.

The feed element 84 is to connect the edge 60 of the housing 55 to the metal band 75. In the present example, the feed element 84 is isolated by a grounding tap 92 and a grounding tap 94 on either side of the feed element 84 to provide a slot antenna. Similarly, the feed element 86 is to connect the edge 60 of the housing 55 to the metal band 75. In the present example, the feed element 86 is isolated by the grounding tap 94 and a grounding tap 96 on either side of the feed element 86 to provide a slot antenna. In other examples, the grounding tap 94 may be separated into separate grounding taps between the slot antenna associated with the feed element 84 and the slot antenna associated with the feed element 86. It is to be appreciated that this structure provides a pair of highly isolated slot antennas that use the metal band 75.

In the present example, the slot antennas with the feed elements 84, 86 along with the antennas with the feed elements 80, 82 may be used together to operate in a second mode for a wide area network, such as a 4×4 Long-Term Evolution (LTE) multiple-input and multiple-output (MIMO) antenna array to connect to mid-band wireless wide area networks that operate between 1710 MHz to 2170 MHz and/or high-band wireless wide area networks that operate between 2305 MHz to 2690 MHz. In particular, the metal band 65 may be a tunable main antenna for this operation, the metal band 70 may be used as a tunable diversity antenna in this mode, and the slot antennas on the metal band 75 may be additional diversity antennas. It is to be appreciated that in a 4×4 LTE MIMO mode such as in the present example, the antenna associated with the feed element 80 may be the main antenna to carry out transmit and receive functions while the antennas associated with the feed elements 82, 84, 86 are to carry out receive only functions.

In the present example, an addition feed element 88 is disposed between the feed element 80 and the feed element 84. The feed element 88 is connected to a radiating element 89 co-located proximate to the feed element 80, but electrically isolated from the housing 55 and the metal band 65. It is to be appreciated that the feed element 88 and the radiating element 89 form an antenna with an inverted-F structure that is well isolated from the antennas associated with the feed element 80 and the feed element 84 despite the close proximity to the latter two antennas. Similarly, an addition feed element 90 is disposed between the feed element 82 and the feed element 86. The feed element 90 is connected to a radiating element 91 co-located proximate to the feed element 82, but electrically isolated from the housing 55 and the metal band 70. It is to be appreciated that the feed element 90 and the radiating element 91 form an antenna with an inverted-F structure that is well isolated from the antennas associated with the feed element 82 and the feed element 86 despite the close proximity to the latter two antennas.

In the present example, the radiating element 89 and the radiating element 91 may be used together to operate with a local area network, such as a 2×2 Wi-Fi multiple-input and multiple-output (MIMO) antenna array to connect to low-band wireless local area networks that may operate at about 2.4 GHz or 5 GHz.

Figure 4:
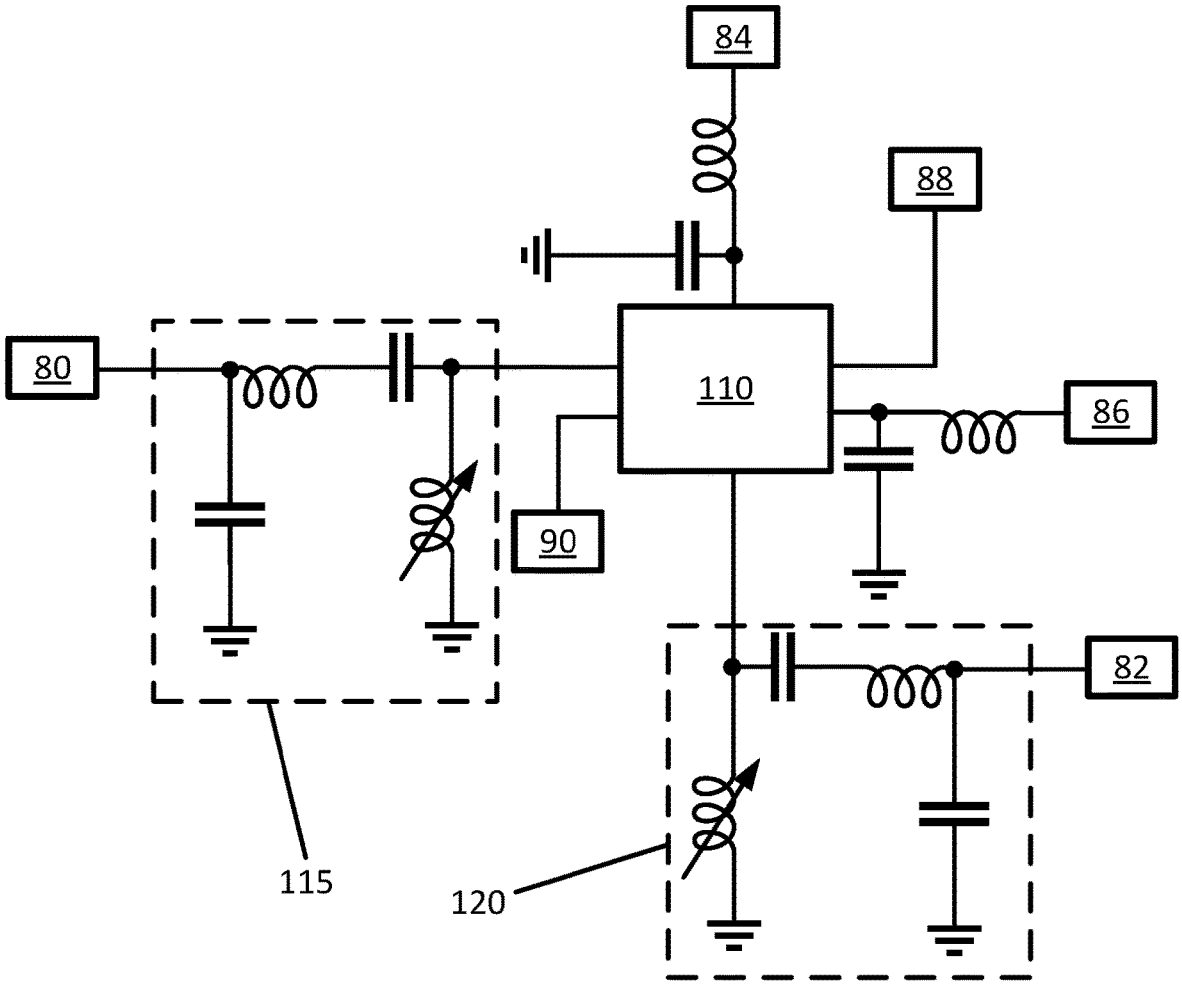
FIG. 4 is a schematic diagram of antenna array circuitry of the example device.

Referring to FIG. 4, a schematic diagram of the antenna array circuitry of the present example. It is to be appreciated that the circuitry may be modified in other examples. In the present example, a processor 110 receives signals from the antennas via the feed elements. In the present example, the signals from the feed element 80 passes through a tunable matching switch 115. In the present example, the tunable matching switch 115 is implemented with a single-pole 3 throw (SP3T) switch. In other examples, it is to be appreciated that the tunable matching switch 115 may be implemented with a single-pole 4 throw (SP4T) switch. Similarly, the signals from the feed element 82 passes through a tunable matching switch 120. In the present embodiment, the tunable matching switch 115 is also implemented with a single-pole 3 throw (SP3T) switch. In other examples, it is to be appreciated that the tunable matching switch 115 may be implemented with a single-pole 4 throw (SP4T) switch The processor 110 is to send and receive signals from the antenna array to communicate with a wireless network for operation of the device 50. The processor 110 may include a central processing unit (CPU), a microcontroller, a microprocessor, a processing core, a field-programmable gate array (FPGA), an application-specific integrated circuit (ASIC), or similar. In the present example, the processor 110 may cooperate with a memory storage unit (not shown) to execute various instructions and to store data received via a wireless network. For example, the processor 110 may operate various applications on the device 50 that use a network connection with which a user may interact.

Figure 5:
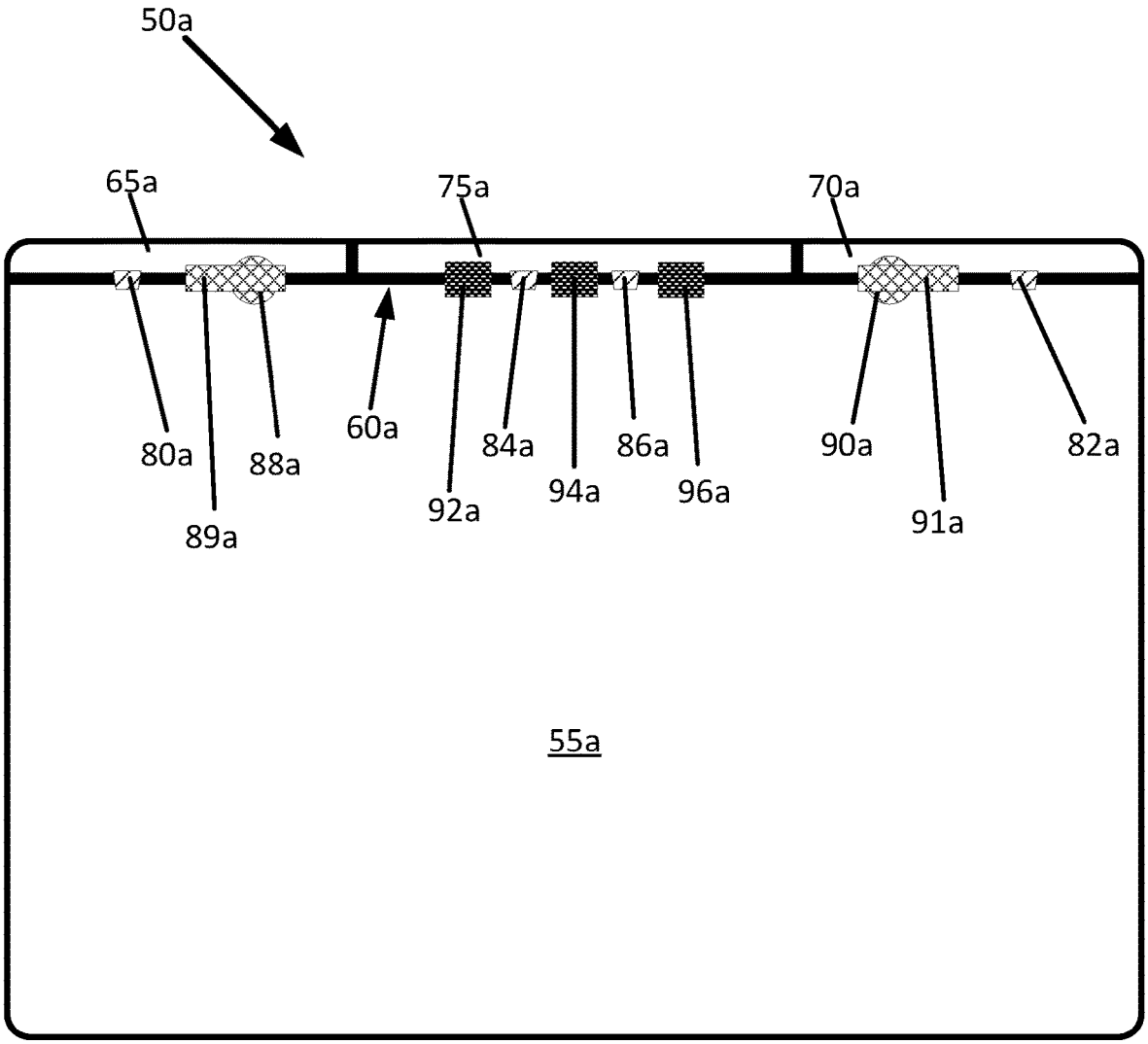
FIG. 5 is a top view of components forming an antenna array of another example device.

Referring to FIG. 5, another device is generally shown at 50*a*. Like components of the device 50*a* bear like reference to their counterparts in the device 50, except followed by the suffix "a". In the present example, the device 50*a* includes a housing 55*a*.

The housing 55*a* is not particularly limited and is to enclose the internal components of the device 50*a*. In the present example, the housing 55*a* is a metal housing which may be manufactured from any one of the materials discussed above in connection with the housing 55. In the present example, the housing 55*a* includes a metal edge 60*a* which is straight and substantially extends along one side of the device 50*a*.

Located across the metal edge 60*a* of the housing 55*a*, a metal band 65*a* is positioned parallel to the metal edge 60*a* and proximate to a corner of the device 50*a*. A metal band 70*a* is located across the metal edge 60*a* of the housing 55*a* at the opposite corner of the metal band 65*a* and is positioned parallel to the metal edge 60*a*. The metal band 75*a* is disposed between the metal band 65*a* and the metal band 70*a*. In the present example, the metal bands 65*a*, 70*a*, 75*a* function similarly with the device 50*a* as the metal bands 65, 70, 75 function with the device 50. The device 50*a* also include a plurality of grounding taps 92*a*, 94*a*, 96*a* to form closed slot antenna structures.

As shown in FIG. 5, the housing 55*a* may be used as part of an antenna array to connect with various wireless wide area networks and wireless local area networks. In the present example, the antenna array includes the feed elements 80*a*, 82*a*, 84*a*, 86*a* connected to various parts of the housing 55*a* as well as feed elements 88*a*, 90*a* connected to radiating elements 89*a*, 91*a*, respectively.

Figure 6:
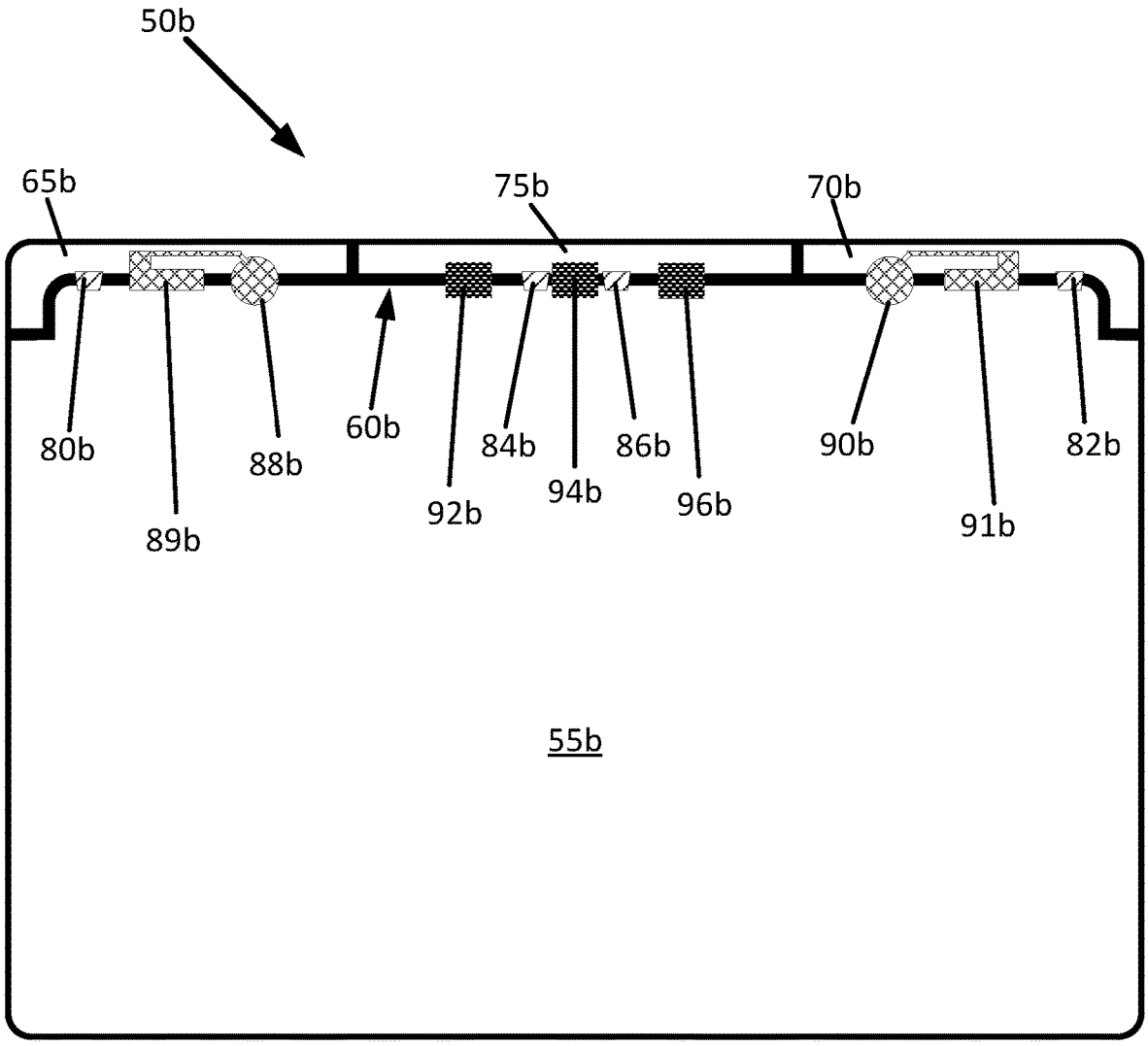
FIG. 6 is a top view of components forming an antenna array of another example device.

Referring to FIG. 6, another device is generally shown at 50*b*. Like components of the device 50*b* bear like reference to their counterparts in the device 50, except followed by the suffix "b". In the present example, the device 50*b* includes a housing 55*b*.

The housing 55*b* is not particularly limited and is to enclose the internal components of the device 50*b*. In the present example, the housing 55*b* is a metal housing which may be manufactured from any one of the materials discussed above in connection with the housing 55. In the present example, the housing 55*b* includes a metal edge 60*b* which is straight and substantially extends along one side of the device 50*b*.

Located across the metal edge 60*b* of the housing 55*b*, a metal band 65*b* is positioned substantially parallel to the metal edge 60*b* and proximate to a corner of the device 50*b*. A metal band 70*b* is located across the metal edge 60*b* of the housing 55*b* at the opposite corner of the metal band 65*b* and is positioned substantially parallel to the metal edge 60*b*. The metal band 75*b* is disposed between the metal band 65*b* and the metal band 70*b*. In the present example, the metal bands 65*b*, 70*b*, 75*b* function similarly with the device 50*b* as the metal bands 65, 70, 75 function with the device 50. The device 50*b* also include a plurality of grounding taps 92*b*, 94*b*, 96*b* to form closed slot antenna structures.

As shown in FIG. 6, the housing 55*b* may be used as part of an antenna array to connect with various wireless wide area networks and wireless local area networks. In the present example, the antenna array includes the feed elements 80*b*, 82*b*, 84*b*, 86*b* connected to various parts of the housing 55*b* as well as feed elements 88*b*, 90*b* connected to radiating elements 89*b*, 91*b*, respectively. It is to be appreciated that the radiating elements 89*b*, 91*b* are not particularly limited and the design may be varied to other inverted-F antenna structures.

This antenna arrays described above generally use the metal in the housing in order to excite multiple antennas. Accordingly, the use of the housing as radiating structures provides for a compact and slim device to implement new antenna structures to connect to advanced networks without an increase in the size of the device to accommodate the new antenna structures.

It is to be recognized that features and aspects of the various examples provided above may be combined into further examples that also fall within the scope of the present disclosure.

What is claimed is:

1. An antenna array comprising:

a first feed element to connect an edge of a metal housing of a computing device to a first metal band;

a second feed element to connect the edge of the metal housing to a second metal band, wherein the first feed element and the second feed element are to operate in a first mode for a wide area network;

a third feed element to connect the edge of the metal housing to a third metal band;

a fourth feed element to connect the edge of the metal housing to the third metal band, wherein the third feed element and the fourth feed element are isolated with grounding taps, and wherein the first feed element, the second feed element, the third feed element, and the fourth feed element are to operate in a second mode for the wide area network;

a fifth feed element disposed between the first feed element and the third feed element, the fifth feed element to connect to a first radiating element, wherein the first radiating element is isolated from the metal housing; and a sixth feed element disposed between the second feed element and the fourth feed element, the sixth feed element to connect to a second radiating element, wherein the second radiating element is isolated from the metal housing, and wherein the fifth feed element and the sixth feed element are to operate with a local area network.

2. The antenna array of claim 1, wherein the first metal band, the second metal band, the third metal band, and the edge of the metal housing are separated by a dielectric material.

3. The antenna array of claim 2, wherein the dielectric material is plastic.

4. The antenna array of claim 1, comprising a first tunable matching switch connected to the first feed element and a second tunable matching switch connected to the second feed element.

5. The antenna array of claim 1, wherein the first mode is a 2×2 multiple-input and multiple-output mode.

6. The antenna array of claim 5, wherein the second mode is a 4×4 multiple-input and multiple-output mode.

7. The antenna array of claim 6, wherein the fifth feed element and the sixth feed element are to operate in a 2×2 MIMO mode.

8. A metal housing comprising:

a metal edge;

a first metal band connected to the metal edge via a first feed element;

a second metal band connected to the metal edge via a second feed element; and a third metal band disposed between the first metal band and the second metal band, wherein the third metal band is connected to the metal edge with grounding taps to provide a first closed slot antenna structure and a second closed slot antenna structure, wherein the first closed slot antenna structure includes a third feed element, and wherein the second closed slot antenna structure includes a fourth feed element.

9. The metal housing of claim 8, wherein the first metal band, the second metal band, the third metal band, and the metal edge are separated by a dielectric material.

10. The metal housing of claim 9, wherein the dielectric material is plastic.

11. The metal housing of claim 8, wherein the first metal band and the second metal band are to operate in a first mode for a wide area network.

12. The metal housing of claim 11, wherein the first metal band, the second metal band, the first closed slot antenna structure, and the second closed slot antenna structure are to operate in a second mode for the wide area network.

13. A device comprising:

a display panel;

a border region around the display panel;

a cover disposed on the display panel and the border region;

a metal housing connected to the cover, the metal housing having a first metal band, a second metal band, and a third metal band, wherein a first metal band, a second metal band, and a third metal band are separated from an edge of the metal housing, and wherein the metal housing and the cover are to protect the display panel and the border region;

a first feed element to connect the edge of the metal housing to the first metal band;

a second feed element to connect the edge of the metal housing to the second metal band, wherein the first feed element and the second feed element are to operate in a first mode for a wide area network;

a third feed element to connect the edge of the metal housing to a third metal band;

a fourth feed element to connect the edge of the metal housing to the third metal band, wherein the third feed element is for a first closed slot antenna structure and the fourth feed element is for a second closed slot antenna structure, and wherein the first feed element, the second feed element, the third feed element, and the fourth feed element are to operate in a second mode for a wide area network;

a fifth feed element disposed between the first feed element and the third feed element, the fifth feed element to connect to a first radiating element, wherein the first radiating element is isolated from the metal housing; and a sixth feed element disposed between the second feed element and the fourth feed element, the sixth feed element to connect to a second radiating element, wherein the second radiating element is isolated from the metal housing, and wherein the fifth feed element and the sixth feed element are to operate with a local area network.

14. The device of claim 13, further comprising a dielectric material to separate the first metal band, the second metal band, the third metal band, and the edge of the metal housing.

15. The metal housing of claim 14, wherein the dielectric material is plastic.

* * * * *